US009945066B1

(12) United States Patent
Mutton

(10) Patent No.: US 9,945,066 B1
(45) Date of Patent: Apr. 17, 2018

(54) AUTOMATIC IRON TEMPERATURE SETTING BASED ON SENSOR DATA

(71) Applicant: Google Inc., Mountain View, CA (US)

(72) Inventor: Andrew James Edward Mutton, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 1127 days.

(21) Appl. No.: 13/766,817

(22) Filed: Feb. 14, 2013

(51) Int. Cl.
*D06F 75/26* (2006.01)
*D06F 75/06* (2006.01)

(52) U.S. Cl.
CPC ..... *D06F 75/26* (2013.01)

(58) Field of Classification Search
CPC ..... D06F 75/26; D06F 75/00; H05B 1/0213
USPC ..... 38/77.9, 103, 137, 69, 74, 77.1, 77.6, 38/144, 14–15; 219/248, 245, 249, 257, 219/502; 2/69, 85, 87
See application file for complete search history.

(56) References Cited

U.S. PATENT DOCUMENTS

| | | | | |
|---|---|---|---|---|
| 4,203,101 | A * | 5/1980 | Towsend | D06F 75/26 200/61.85 |
| 5,721,418 | A * | 2/1998 | Hazan | D06F 75/40 219/257 |
| 6,438,876 | B2 | 8/2002 | Har et al. | |
| 6,649,882 | B1 * | 11/2003 | Hervieu et al. | 219/494 |
| 7,779,565 | B2 * | 8/2010 | Jiang et al. | 38/103 |
| 2006/0005071 | A1 * | 1/2006 | Fu | 714/5 |
| 2007/0144035 | A1 | 6/2007 | Choi et al. | |
| 2008/0052970 | A1 * | 3/2008 | Lee | 38/75 |
| 2010/0321161 | A1 | 12/2010 | Isabell | |

FOREIGN PATENT DOCUMENTS

| | | | |
|---|---|---|---|
| EP | 2 431 517 | | 3/2012 |
| KR | 2009068128 A | * | 6/2009 |

OTHER PUBLICATIONS

KR2009068128_translation.pdf.*
Anonymous,"RFID Apparel Tag, Specialized Tag, RFID Animal Tag, RFID Clothing, RFID Animal Management", Available at: http://www.ictagsolutions.com/specializedtags.html. Last visited on: Jan. 15, 2013.
Anonynnous,"RFID Iron on Laundry Tag", Available at: http://www.fricknet.com/Products/SmartMark_RFID/RFID_Iron_On_Laundry_Tag.html. Last visited on: Jan. 15, 2013.
Anonymous,"Tactile robot finger outperforms humans in identifying textures", Available at: http://www.gizmag.com/biotac-tactile-robot-finger/23002/. Last visited on: Jan. 15, 2013.

* cited by examiner

*Primary Examiner* — Dana Ross
*Assistant Examiner* — Ket D Dang
(74) *Attorney, Agent, or Firm* — Morris & Kamlay LLP

(57) ABSTRACT

An iron may autonomously set the appropriate ironing parameter by obtaining information about the garment to be ironed. Data may be received from an indicator located on a garment to be ironed. An indicator may include the actual type of fabric associated with a garment, or an information tag attached to a garment. The received data may be decoded to determine the ironing parameters for the garment to be ironed. Based on the determined ironing parameters, the associated settings may be automatically adjusted on an iron.

11 Claims, 2 Drawing Sheets

AUTOMATIC IRON TEMPERATURE SETTING BASED ON SENSOR DATA

BACKGROUND

Many clothing irons have an interface that allows a user to manually select the iron's operating temperature and application of steam. The user must set the temperature manually based upon the user's knowledge of the type of fabric and appropriate temperature for that type of fabric. If the user misapprehends the fabric type or appropriate temperature, the garment may become damaged during ironing or else may remain wrinkled.

BRIEF SUMMARY

The implementation of the disclosed subject matter relates generally to controlling and determining a parameter of an iron. More specifically, the implementation relates to methods and devices that may set the appropriate ironing parameter automatically by obtaining information about the garment to be ironed. The present disclosure contemplates a new and improved system and method that resolves the above-referenced difficulties and others.

The present disclosure is directed to methods and systems for autonomously identifying a fabric and setting the ironing parameters for the associated fabric. In an implementation, a method may include receiving data from an indicator located on a garment to be ironed. An indicator may include the actual type of fabric associated with a garment, or an information tag attached to a garment. The received data may be decoded to determine ironing parameters for the garment to be ironed. Based on the determined ironing parameters, the associated settings may be automatically adjusted.

In an implementation, the information tag may be an RFID tag, a barcode, or any other related identifiers that may be attached to a garment. In addition a remote server, a home automation system or a processor on board the iron may decode the received data. Once decoded, the ironing parameters may be received from the remote server, home automation system or processor on board. In an implementation, ironing parameters may include the temperature a fabric may receive heat, the length of time an iron may apply heat, the amount of steam an iron may apply, or other parameters related to pressing clothing garments. Accordingly, an implementation may set and maintain a constant temperature, set the length of time the iron may apply heat and indicate the time has expired, or set the amount of steam an iron may apply and upon disbursement of the allotted steam restricting the iron from releasing steam.

In accordance with another aspect of the disclosed subject matter, a system may include a sensor and a processor. A sensor may be configured to receive data from an indicator located on a garment to be ironed. The processor may be configured to determine the ironing parameters for the garment. The processor may also be configured to adjust the associated settings.

Additional features, advantages, and implementations of the disclosed subject matter may be set forth or apparent from consideration of the following detailed description, drawings, and claims. Moreover, it is to be understood that both the foregoing summary and the following detailed description provide examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

Figure 1:
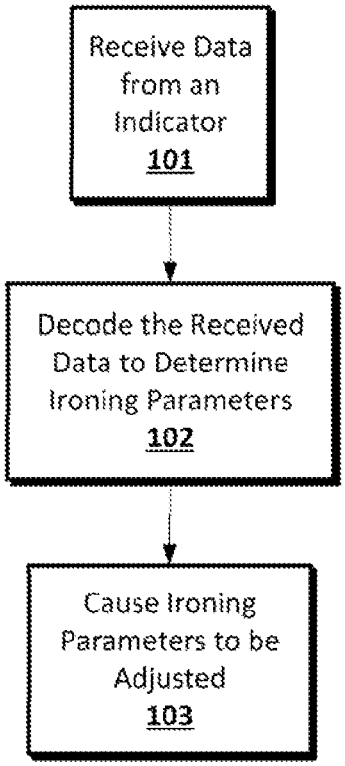
FIG. 1 is a flow chart illustrating a method for autonomously identifying a fabric and setting the ironing parameters for the associated fabric according to an implementation of the disclosed subject matter.

Referring now to the drawings wherein the showings are for purposes of illustrating the preferred implementation of the disclosed subject matter only and not for purposes of limiting same, FIG. 1 provides a view of an example method according to the present disclosure. FIG. 1 shows a method for autonomously identifying a fabric and setting the ironing parameters for the associated fabric.

The implementation shown in FIG. 1 may receive 101 data from an indicator located on (disposed on a surface, embedded in or otherwise being a part of) a garment to be ironed. The indicator may include an actual type of fabric associated with a garment, or an information tag attached to a garment. An implementation may incorporate a touch sensor in the iron, such as on the soleplate. A touch sensor may be configured in such a way that when it slides over a textured surface, it vibrates in characteristic ways. A hydrophone may be located within the sensor to detect these vibrations, similar to the way in which a human finger uses similar vibrations to recognize textures. For example, the iron may be fitted with a touch sensor that when placed against a linen shirt the sensor receives a particular vibration associated with linen. Likewise, an implementation may include a touch sensor that when placed against a cotton scarf the sensor receives a particular vibration associated with cotton.

An implementation may sense that the user is tilting the iron from its resting position on its end, (i.e. where the soleplate isn't in contact with anything) and activate the touch sensor. An implementation may use, for example, a gyroscope, an accelerometer, rotary encoder, potentiometer, or other related absolute position or displacement position sensors to determine whether the user has tilted the iron. Once the touch sensor has made contact with a particular garment, an implementation may receive a particular vibration associated with the fabric. The iron's settings may be activated based on the identification of the fabric, as described herein.

An implementation may also receive data from an information tag attached to the garment. The information tag may be an RFID tag, a barcode (any optically scannable indication), or any other related identifier or identifiers that may be associated with a garment. For example, the information tag may be located on the clothing tag of the garment, sublimated as a pattern on the garment or embedded within the fabric of the garment. For example, in an implementation, an iron may include a scanning antenna configured to interrogate an RFID tag embedded within a shirt. A scanning antenna may interrogate an RFID tag located on a tag attached to the shirt. When the scanning antenna may be relatively close to the garment with the RFID tag, the RFID may be a passive-tag. A passive-tag can also allow the physical tag to be very small, be durable and last for a long time. An implementation can include a device (a contact indicator) disposed in or on the fabric that, upon making electrical contact with the soleplate or a sensor embedded in the soleplate, transfers to the iron information about the garment. The contact indicator can include a memory storage device that stores garment information. The memory storage device can be coupled to a contact element such that a sensor in contact with the contact element can access or receive at least some of the garment data stored in the memory device.

An implementation of disclosed subject matter may include a sensor that can optically scan a barcode. A barcode may be used where an implementation utilizes digital optical scanners or where the tag holds a large amount of information. For example, a barcode associated with a linen jacket may store all of the known ironing parameters for linen (e.g. apply heat up to 230° C., iron on interior side while damp, apply light steam). An implementation may also optically scan a barcode located on the clothing tag. For example, a barcode associated with a linen jacket may store the recommended heat setting (e.g. apply heat up to 230° C.).

The received data associated with the type of tag may be decoded 102 to retrieve the associated information. The information received may be instructions to care for the particular garment. This may include specific instructions to wash, dry, and press the garment. In an implementation of the disclosed subject matter, the indicator (such as a barcode) may include a link such as a URL to a server. The server can be a local server (such as a server on a home network) or a remote server away from the location of the iron. The remote server may be a remote physical computer, or a cloud-based server configured to run one or more service to serve the needs of the implementation. An implementation may also use a home automation system may decode the received data to determine the ironing parameters. The home automation system may be a home gateway, or a cloud-based server configured to provide home automation throughout a home. A home automation system may provide an interface that enables an implementation to connect to the home network to interact and share data. The link can include information about the content or type of garment and/or cloth used in the garment, or a product identifier for the garment such as a UPC or EPC code. An implementation can communicate with a server based on the link or other information contained in the indicator and obtain instructions based on the information sent to the server and data stored at the server, such as iron setting data, garment data, cloth data, etc. The instructions can include settings information for the iron. In implementations, the iron can send iron identification data to the server so that the server can select settings appropriate for that iron by make, model or individual iron. Further, the server can store profile information about the user of the iron, the user's garments, or the user's preferences (such as preferences about the use of starch, steam, ironing temperatures, etc.)

An implementation may incorporate an on-board processor to decode the received data from an RFID tag, a barcode, or any other related identifiers that may be attached to a garment.

In an implementation with a touch sensor, the received vibrations or data based on the detected vibrations may be sent to a remote server to compare to known fabrics and their associated vibration characteristics. An implementation may also send the received vibrations to a home automation system to compare to known characteristic vibrations. In addition, an implementation may incorporate a memory to store known fabrics and their associated vibration signatures. An on-board processor at the iron or in another home network appliance or device may be used to compare the received vibrations to known vibrations to determine the fabric of the garment.

Once the fabric is determined, an implementation may determine the associated ironing parameters for the specific fabric. The ironing parameters may be stored in a remote server, a cloud based server, a home automation system or within the on-board memory. The ironing parameters may include the temperature a fabric may receive heat, the length of time an iron may apply heat, the amount of steam an iron may apply, or other parameters related to pressing clothing garments.

Based on the determined ironing parameters, the associated settings may be adjusted may be adjusted 103 by the implementation. An implementation can receive an indication of a specific fabric and set the data based on the recognized fabric. For example, an implementation may determine that a garment is made up of press silk (e.g., pure silk, shantung, satins, organza, georgette, chiffons and taffetas) based on data received from the indicator. The implementation may determine that the garment may be effectively and safely pressed at an iron temperature of 120 degrees or a pre-set temperature level, such as 2. An implementation may determine that a garment is made up of press linen, which may be pressed at the iron's hottest setting. An implementation may also receive an operating temperature or temperature range from the decoded data. Similarly, an implementation may also determine the length of time an iron may apply heat, the amount of steam an iron may apply, or other parameters related to pressing clothing garments. If an amount of time is determined, an implementation may automatically cool or turn off an iron after the expiration of a time period based on the determined amount of time.

Upon setting the temperature, an implementation may maintain a constant temperature for the garment. Furthermore, an implementation may set the length of time the iron may apply heat based on the received parameters. Likewise, an implementation may indicate to a user the time has expired upon expiration of the time. An implementation may also set the amount of steam an iron may apply based on the received parameters and restrict the iron from further releasing steam upon disbursement of the set amount of steam.

While various implementations of the present disclosure have been described above, it should be understood that they have been presented by way of example and not limitation. It will be apparent to one skilled in the pertinent art that various changes in form and detail can be made therein without departing from the spirit and scope of the present disclosure.

Figure 2:
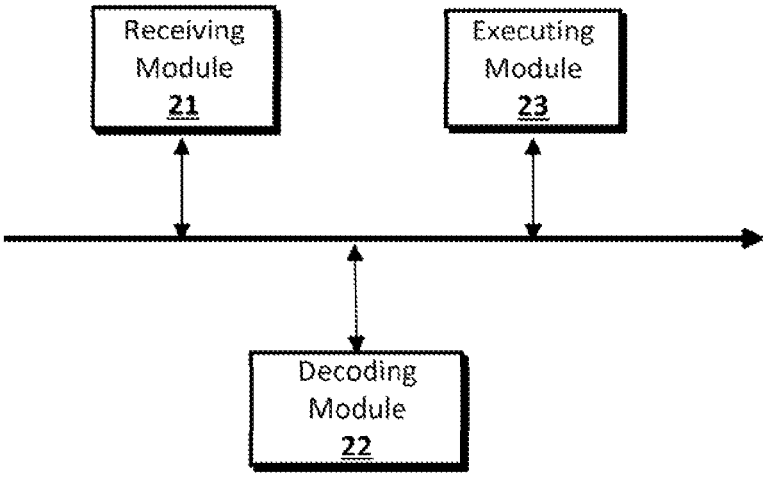
FIG. 2 is a block diagram illustrating a communications network including a system for practicing aspects of the present implementation of the disclosed subject matter.

FIG. 2 shows a system for autonomously identifying a fabric and setting the ironing parameters for the associated fabric. The system may include a receiving module 21 and a decoding module 22. The receiving module 21 may be configured to receive data from an indicator located on a garment to be ironed as described above. Examples of a receiving module 21 can include an optical scanner suitable for scanning barcodes and the like, a RFID sensor capable of communicating with an RFID, a touch sensor capable of sensing properties of a fabric directly and a contact sensor that can make electrical contact with an indicator embedded in or on the fabric to obtain fabric information. Furthermore, the decoding module 22 may decode the received data to determine the ironing parameters for a garment to be ironed or to send information received from the receiving module 21 to a server. The information sent to the server can include one or more properties of the iron (iron identifier, iron capability, present iron settings, etc.) and properties of the garment or fabric obtained by the receiving module 21 from the indicator. The decoding module can communicate with the server to obtain additional information about the content of the garment, the identity of the iron, such as its identifier, type, properties, capabilities, operating parameters, current settings and the like, or a combination thereof. The system may also include an executing module 23. The executing module 23 may cause ironing parameters of an iron to be adjusted based on information from the decoding module 22.

Figure 3:
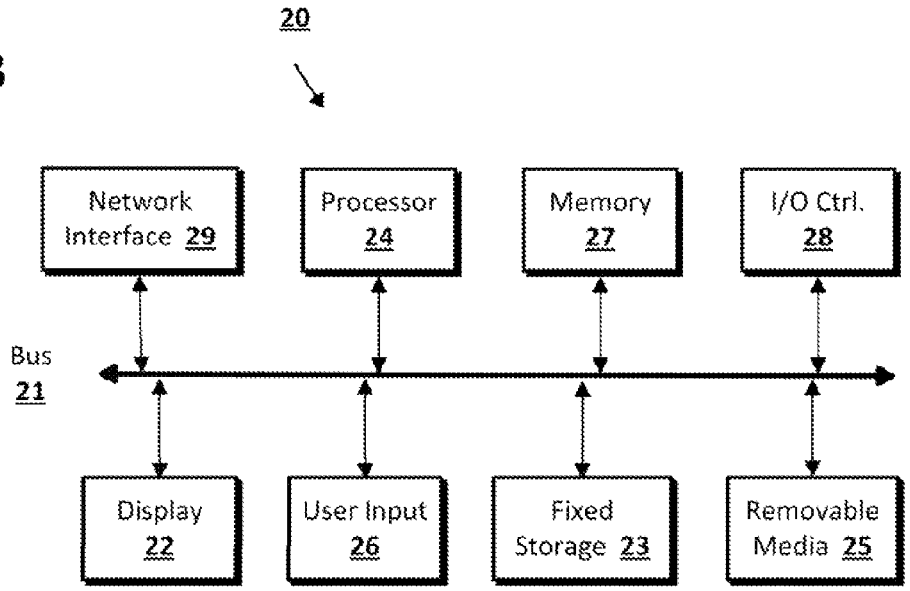
FIG. 3 shows a computer according to an implementation of the disclosed subject matter.

Embodiments of the presently disclosed subject matter may be implemented in and used with a variety of component and network architectures. FIG. 3 is an example computer 20 suitable for implementing embodiments of the presently disclosed subject matter. The computer 20 includes a bus 21 which interconnects major components of the computer 20, such as a central processor 24, a memory 27 (typically RAM, but which may also include ROM, flash RAM, or the like), an input/output controller 28, a user display 22, such as a display screen via a display adapter, a user input interface 26, which may include one or more controllers and associated user input devices such as a keyboard, mouse, and the like, and may be closely coupled to the I/O controller 28, fixed storage 23, such as a hard drive, flash storage, Fibre Channel network, SAN device, SCSI device, and the like, and a removable media component 25 operative to control and receive an optical disk, flash drive, and the like.

The bus 21 allows data communication between the central processor 24 and the memory 27, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS), which controls basic hardware operation such as the interaction with peripheral components. Applications resident with the computer 20 are generally stored on and accessed via a computer readable medium, such as a hard disk drive (e.g., fixed storage 23), an optical drive, floppy disk, or other storage medium 25.

The fixed storage 23 may be integral with the computer 20 or may be separate and accessed through other interfaces. A network interface 29 may provide a direct connection to a remote server via a telephone link, to the Internet via an Internet service provider (ISP), or a direct connection to a remote server via a direct network link to the Internet via a POP (point of presence) or other technique. The network interface 29 may provide such connection using wireless techniques, including digital cellular telephone connection, Cellular Digital Packet Data (CDPD) connection, digital satellite data connection or the like. For example, the network interface 29 may allow the computer to communicate with other computers via one or more local, wide-area, or other networks, as shown in FIG. 4.

Many other devices or components (not shown) may be connected in a similar manner (e.g., document scanners, digital cameras and so on). Conversely, all of the components shown in FIG. 3 need not be present to practice the present disclosure. The components can be interconnected in different ways from that shown. The operation of a computer such as that shown in FIG. 3 is readily known in the art and is not discussed in detail in this application. Code to implement the present disclosure can be stored in computer-readable storage media such as one or more of the memory 27, fixed storage 23, removable media 25, or on a remote storage location.

Figure 4:
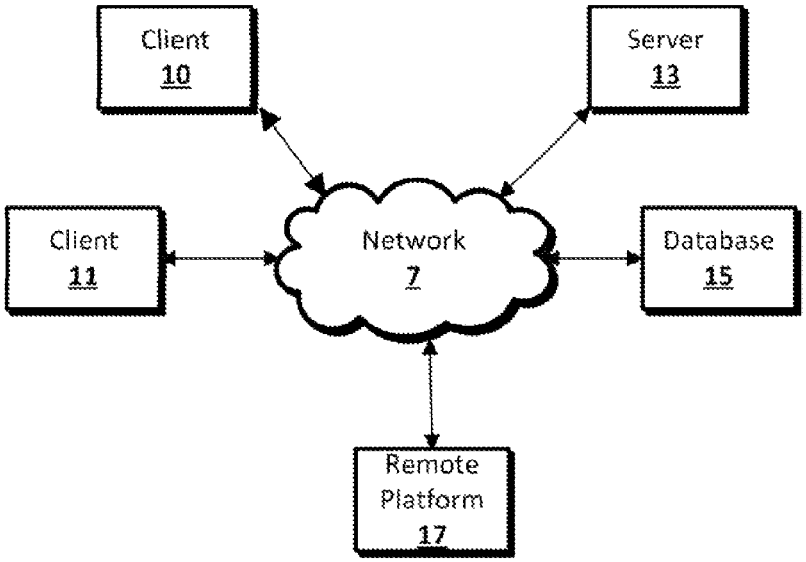
FIG. 4 shows a network configuration according to an implementation of the disclosed subject matter.

FIG. 4 shows an example network arrangement according to an embodiment of the disclosed subject matter. One or more clients 10, 11, such as local computers, smart phones, tablet computing devices, and the like may connect to other devices via one or more networks 7. The network may be a local network, wide-area network, the Internet, or any other suitable communication network or networks, and may be implemented on any suitable platform including wired and/or wireless networks. The clients may communicate with one or more servers 13 and/or databases 15. The devices may be directly accessible by the clients 10, 11, or one or more other devices may provide intermediary access such as where a server 13 provides access to resources stored in a database 15. The clients 10, 11 also may access remote platforms 17 or services provided by remote platforms 17 such as cloud computing arrangements and services. The remote platform 17 may include one or more servers 13 and/or databases 15.

More generally, various implementations of the presently disclosed subject matter may include or be embodied in the form of computer-implemented processes and apparatuses for practicing those processes. Implementations also may be embodied in the form of a computer program product having computer program code containing instructions embodied in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general-purpose microprocessor and/or an Application Specific Integrated Circuit (ASIC) that embodies all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The foregoing description, for purpose of explanation, has been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A method comprising:

activating a sensor in an iron when the iron is tilted from a resting position of the iron;

at the sensor, receiving data from an indicator located on a garment to be ironed;

decoding the received data to determine ironing parameters for the garment to be ironed; and causing ironing parameters of the iron to be adjusted based at least partly on the decoding the received data to determine ironing parameters for the garment to be ironed.

2. The method as recited in claim 1, wherein the indicator is at least one from the group of a radio frequency identification (RFID) tag, a barcode, a region of fabric and a contact indicator.

3. The method as recited in claim 1, further comprising interrogating an RFID tag.

4. The method as recited in claim 1, further comprising optically scanning a barcode.

5. The method as recited in claim 1, wherein the decoding the received data to determine the ironing parameters for the garment to be ironed comprises obtaining information selected from the group consisting of: a temperature, a steam setting and a time duration.

6. The method as recited in claim 1, wherein the causing of the ironing parameters of the iron to be adjusted comprises setting the iron to a steam setting.

7. The method as recited in claim 1, wherein the causing of the ironing parameters of the iron to be adjusted comprises setting a length of time that the iron may apply heat.

8. The method as recited in claim 1, wherein the causing of the ironing parameters of the iron to be adjusted comprises setting an amount of steam the iron may apply and causing the iron to disburse the set amount of steam.

9. The method as recited in claim 1, wherein decoding the received data to determine the ironing parameters for the garment to be ironed comprises sending data to a server and receiving ironing parameters from the server.

10. The method as recited in claim 9, wherein the server is a home automation server.

11. The method as recited in claim 9, wherein the data sent to the server includes at least one from the group consisting of: a property of the iron and a property of the garment.

* * * * *